US009217191B2

(12) United States Patent
Gulbrandsen Dahl et al.

(10) Patent No.: US 9,217,191 B2
(45) Date of Patent: Dec. 22, 2015

(54) BRASS ALLOY COMPRISING SILICON AND ARSENIC AND A METHOD OF MANUFACTURING THEREOF

(75) Inventors: Sverre Gulbrandsen Dahl, Disenå (NO); Jon Ivar Moe, Raufoss (NO)

(73) Assignee: Raufoss Water & Gas AS, Raufoss (NO)

( * ) Notice: Subject to any disclaimer, the term of this patent is extended or adjusted under 35 U.S.C. 154(b) by 0 days.

(21) Appl. No.: 13/822,267

(22) PCT Filed: Sep. 9, 2011

(86) PCT No.: PCT/EP2011/065644
§ 371 (c)(1),
(2), (4) Date: Mar. 11, 2013

(87) PCT Pub. No.: WO2012/032155
PCT Pub. Date: Mar. 15, 2012

(65) Prior Publication Data

US 2013/0177472 A1 Jul. 11, 2013

(30) Foreign Application Priority Data

Sep. 10, 2010 (EP) ..... 10176301

(51) Int. Cl.
*C22C 9/04* (2006.01)
*C22C 1/02* (2006.01)
*C22F 1/08* (2006.01)

(52) U.S. Cl.
CPC ... *C22C 9/04* (2013.01); *C22C 1/02* (2013.01); *C22F 1/08* (2013.01)

(58) Field of Classification Search
CPC ..... C22C 1/02; C22C 9/04; C22F 1/08
USPC ..... 420/477; 75/376
See application file for complete search history.

(56) References Cited

U.S. PATENT DOCUMENTS

| | | | | |
|---|---|---|---|---|
| 3,900,349 | A | 8/1975 | Costas | |
| 4,362,579 | A * | 12/1982 | Tsuji | 148/681 |
| 2003/0095887 | A1 | 5/2003 | Dong | |
| 2004/0234412 | A1 | 11/2004 | Oishi et al. | |
| 2006/0078458 | A1 | 4/2006 | Strobl et al. | |

FOREIGN PATENT DOCUMENTS

| | | |
|---|---|---|
| CN | 101476056 A | 7/2009 |
| DE | 1558470 | 3/1970 |
| EP | 0872564 | 10/1998 |
| EP | 1045041 | 10/2000 |
| EP | 1600517 | 11/2005 |
| FR | 2356733 | 1/1978 |

OTHER PUBLICATIONS

Skidmore, K.F. and Schwartzbart, H., "Corrosion and Dezincification of Brasses in Water," Journal of Testing and Evaluation, JTEVA, vol. 4, No. 6, Nov. 1976, pp. 426-433.

(Continued)

*Primary Examiner* — Kaj K Olsen
*Assistant Examiner* — Alexander Polyansky
(74) *Attorney, Agent, or Firm* — Avery N. Goldstein; Blue Filament Law

(57) ABSTRACT

An improved brass alloy providing improved ability for machining is detailed that is free of lead and is at the same time environmental friendly. The alloy comprises added alloying elements in an amount that is identified through an iterative process during manufacturing of the alloy.

4 Claims, 3 Drawing Sheets

(56) References Cited

OTHER PUBLICATIONS

Communication pursuant to Article 94(3) EPC, European Application No. 11757591.0, Publication Date Jan. 17, 2014, European Patent Office.

R. Sundberg, S. Hertzman, and M. Linder., "Intergranular Corrosion (IGA) of Brass" Chapter in Copper: Better Properties for Innovative Products, editor J-M Welter, Wiley-VCH Verlag GmbH & Co. KGaA, Jan. 16, 2007, pp. 153-163.

* cited by examiner

BRASS ALLOY COMPRISING SILICON AND ARSENIC AND A METHOD OF MANUFACTURING THEREOF

FIELD OF THE INVENTION

The present invention relates to the field of brass alloys and especially to a brass alloy and a method of manufacturing thereof comprising copper and zinc and at least one added alloying element providing a brass alloy providing beneficial properties with respect to manufacturing processes of items made from this brass alloy, different requirements with respect to environmental conditions items made from this alloy may be subject too, be able to fulfil different standardized requirements for specific use of the alloy, and official limits with respect to pollution standards etc.

BACKGROUND OF THE INVENTION

In prior art the standard brass is an alloy comprising at least copper and zinc. However, different added alloying elements may provide an alloy that can advantageously be used to manufacture items for special use. For example, the seven most used commercially available brass alloys are as follows:

CuZn15 Red brass
CuZn30 Cartridge brass
CuZn30Sn1 Admiralty brass
CuZn40 Muntz metal
CuZn40Sn1 Naval brass
CuZn40Pb1Sn1Fe1Mn0.3 Manganese bronze
CuZn22Al2As0.05 Aluminium brass As readily understood, these brass alloys have different material properties that are beneficial when producing for example ammunition, using the alloy in marine environments etc.

Generally, the ability of the brass alloy to be subject to machining is an important parameter which reflects how the brass alloy provides wear and tear of tools that are used during the machining process. Wear of tools are an important economical parameter in production plants. Some of the interesting parameters during production comprising using brass alloys are:

state of surface of the machined parts
cutting speed
fragmentation of chips
lifetime of the tool Also, the ability for casting the brass alloy is important, for example 10 temperature level for casting, cooling time providing restructuring of the alloy etc. Further, it is also important how easily a brass bolt for example may be extruded. For example, resistance towards cracking when extruded, the force that is necessary to apply when extruding, time that must be used for achieving an end result etc. All of these parameters are possible to control, to alter, to enhance etc. with addition of different alloying elements when manufacturing the brass alloy. For example, addition of lead may improve the ability for machining the brass alloy as known to a person skilled in the art. The content of Zinc in an alloy is primarily an economical way of producing a cheaper alloy (reduces the content of copper). One problem with the Zinc is the process of dezincification when the brass alloy is in contact with water. This is for example the case with brass components used in water supply systems. It is known in prior art that for example arsenic added in small portions as an alloying element stops or reduces significantly dezincification of items made of brass alloy in water.

The phase map of a copper-zinc system (ref. FIG. 1) illustrates that in the range of 0-40% Zn in the brass alloy, the brass can be structured in two different phases, α and β, depending on the temperature and the composition of the alloy. Below 35% Zinc, alloys are exclusively α phase. But between 35% and 40% Zinc, the structure can be either a pure α phase or a mix of α and β phase, which is called duplex structure. The β phase is preserved at room temperature but is subject to a long range ordering at 454° C. to form β'. This ordering reaction cannot be avoided even by drastic quenching. FIG. 2 illustrates some of the structures. At room temperature, the α phase has a minimum when there is 64% Cu content in the alloy, while the β' phase has a maximum when there is 54% Cu content in the alloy. The structure of the alloy determines very important properties of the alloy as known to a person skilled in the art. The two most important parameters are the resistance towards corrosion and the ability to be cold or hot deformed.

The ability of the brass to be shaped is dependent upon the temperature and the structure of the alloy. It is known in prior art that α phase provides a brass with very good ability to be cold worked while the brass withstands hot working.

Contrary, the β phase has a very low resistance towards hot working. The duplex brass is known to be the most easily worked copper alloy because it combines the advantages of both α and β phases. Thus it has respectively both hot and cold working abilities.

With reference to the phase map in FIG. 1, the α phase comprises more copper than the β phase. The α phase is therefore more noble than the β phase. It means that when the two phases are present (duplex brass), a galvanic connection is formed and the β phase, which is the less noble one, will be corroded first.

Thus, a duplex brass cannot in any case be protected against corrosion, due to its nature of a mix of two phases.

A pure α structure can be protected against corrosion if an inhibitor is alloyed in small amounts.

Arsenic, phosphorus and antimony are known examples providing protection against dezincification. However, there is a risk of inter granular corrosion. Therefore, the content of such alloying elements are usually very small.

However, it has been known for some time that for example lead pollution from brass alloys (used to enhance machining ability) is harmful to the human body. [W. Heller, Copper based alloys in Materials Science and Technology, Eds. R. W. Cahn, P. Haasen and E. J. Kramer, Vol 8, Chapt. 6 (1996)].

Recent epidemiological research finds that even exposure to low-level concentrations of lead over long periods of time can badly affect the development of infant intelligence and it is said there is some effect on hormonal development [Kentaro Iijima, Takamitsu Otake, Jun Yoshinaga, Miyuki Ikegami, Emiko Suzuki, Hiroshi Naruse, Tomoya Yamanaka, Noriko Shibuya, Takehiko Yasumizu and Nobumasa Kato, Biological Trace Element Research, Cadmium, Lead, and Selenium in Cord Blood and Thyroid Hormone Status of Newborns, Volume 119, Number 1/October, 2007, pp. 10-18]. As a result government agencies and private industry are making efforts to reduce lead content in products used in distribution of drinking water. [California, Czech].

Typical copper alloys used in the production of brass rod, brass forging and bronze casting contain several percentage points of lead to improve ability of machining the alloy [H. Sigurdsson, Dezincification and stress corrosion cracking of brass—A literature survey, Raufoss Materials Technology report Jul. 10, 1999, (1999)].

Unfortunately lead content results in environmental problems such as lead leaching into the drinking water, lead dust during machining and casting, and disposal of lead-contaminated foundry sand. Hence it has long been desired to develop lead-free brass alloys that do not harm humans or the environment. In addition, maximum content of other heavy metals like arsenic is debated.

Further, Arsenic, Phosphorous and Antimony leaking from brass alloys to the surrounding environment may be a hazard due to possible toxic properties of such alloying elements.

In prior art CN 1616695 describes a brass alloy comprising 80-84 wt % Cu, 2.5-5 wt % Si, 0.02-0.1 wt % As and the rest is Zinc.

20 JP 56009347 disclose a brass alloy comprising 25-37 wt % ZN, 0.005-2 wt % Si, 0.002-0.5 P, the rest is Cu.

JP 58022347 disclose a brass alloy comprising 25-35 wt % Zn, 0.005-2 wt % Si, 0.005-0.5 wt % P and the rest is CU.

GB 1443090 A discloses brass alloys comprising copper, zinc and silicon with addition of an inhibitor like arsenic. In Table II in the publication the dezincification resistance performance of different alloys are presented. All alloys providing dezincification resistance comprises arsenic levels from 0.03 wt % and upwards. It is also disclosed that an alloy with 79 wt % copper and 3-4 wt % silicon can achieve dezincification if the arsenic level is 0.01 wt %. In general has all the disclosed alloys in this publication has a copper level of 74 wt % copper and upwards. This implies that the microstructures of the alloys will be either a pure α phase or a mixture of α- and ζ-phase.

FR 2356733 A1 discloses alloys comprising copper, zinc, silicon, manganese, arsenic, aluminum and tin. Lead is added to achieve machining capabilities. These alloys exhibit possible hazards to the environment as described above.

Hence, an improved brass alloy would be advantageous, and in particular a more environmental friendly brass alloy that at the same time provides good material properties for different manufacturing processes comprising the improved brass alloy, and at the same time may be produced according to an economical and technical efficient method for production of the brass alloy according to the present invention.

OBJECT OF THE INVENTION

It is a further object of the present invention to provide an alternative to the prior art.

In particular, it may be seen as an object of the present invention to provide a lead-free, free-cutting copper alloy which comprises a certain amount of wt % copper; a certain amount of wt % silicon; and the remaining wt % zinc, and wherein the copper alloy optionally further includes one of: a certain amount of wt % arsenic, or a certain amount of wt % arsenic and a certain amount of wt % phosphorus.

It is further an object of the present invention to provide a method of manufacturing an improved brass alloy comprising steps for assessing a necessary amount of alloying elements that at the same time enhance material properties and still is environmentally friendly, and steps for assessing a heating process providing a restructuring of the brass alloy combined with a cooling period preserving the obtained restructuring of the brass alloy.

SUMMARY OF THE INVENTION

Thus, the above described object and several other objects are intended to be obtained in a first aspect of the invention by providing an improved brass alloy being lead free comprising an amount of an added alloying element that during steps of manufacturing is becoming an integral part of the material structure of the final brass alloy.

In an example of embodiment of the present invention, a brass alloy which is suited for production of castings, extruded profiles/rods, wrought products, and machined goods, which can be subject to dezincification due to contact with water and other liquids is produced.

Brass is exposed to a variety of different types of corrosion, and one of the most severe corrosion forms of brass in contact with water is dezincification as explained above. This is a so called selective corrosion types where zinc in the brass alloy is dissolved and the product is left as a porous copper/copper oxide. In the composition range 30-50 wt % zinc, brass consists of two crystalline phases, α- and β-phase as explained above. Both crystalline phases are subject to dezincification, but the α-phase may become resistant to dezincification by aid of added inhibitors.

Brass is an extremely formable material. This causes challenges with respect to machining of such materials. According to an aspect of the present invention an improved free-cutting brass alloy without lead comprises silicon (Si) and phosphorus (P) and Arsenic (As) providing dezincification resistance and machining ability. The improved brass alloy according to the present invention comprising silicon (Si), very low contents of arsenic (As), phosphorus (P) and lead (Pb), combines dezincification resistance, formability, machining ability, and low tool wear in a unique way.

The present invention further relates to a method being adapted to enable a production of an improved brass alloy according to the present invention.

This aspect of the invention is particularly, but not exclusively, advantageous in that the method according to the present invention may provide a learning phase for a particular production facility to be able to mass produce the improved brass alloy according to the present invention.

It is within the scope of the present invention that different aspects of the present invention may each be combined with any of the other aspects. These and other aspects of the invention will be apparent from and elucidated with reference to the embodiments described hereinafter. It is also within the scope of the present invention that different steps of a method according to the present invention may comprise altering the sequence of steps.

BRIEF DESCRIPTION OF THE FIGURES

The improved brass alloy according to the present invention will now be described in more detail with regard to the accompanying figures. The figures show one way of implementing the present invention and is not to be construed as being limiting to other possible embodiments falling within the scope of the attached claim set.

DETAILED DESCRIPTION OF AN EMBODIMENT

Figure 1:
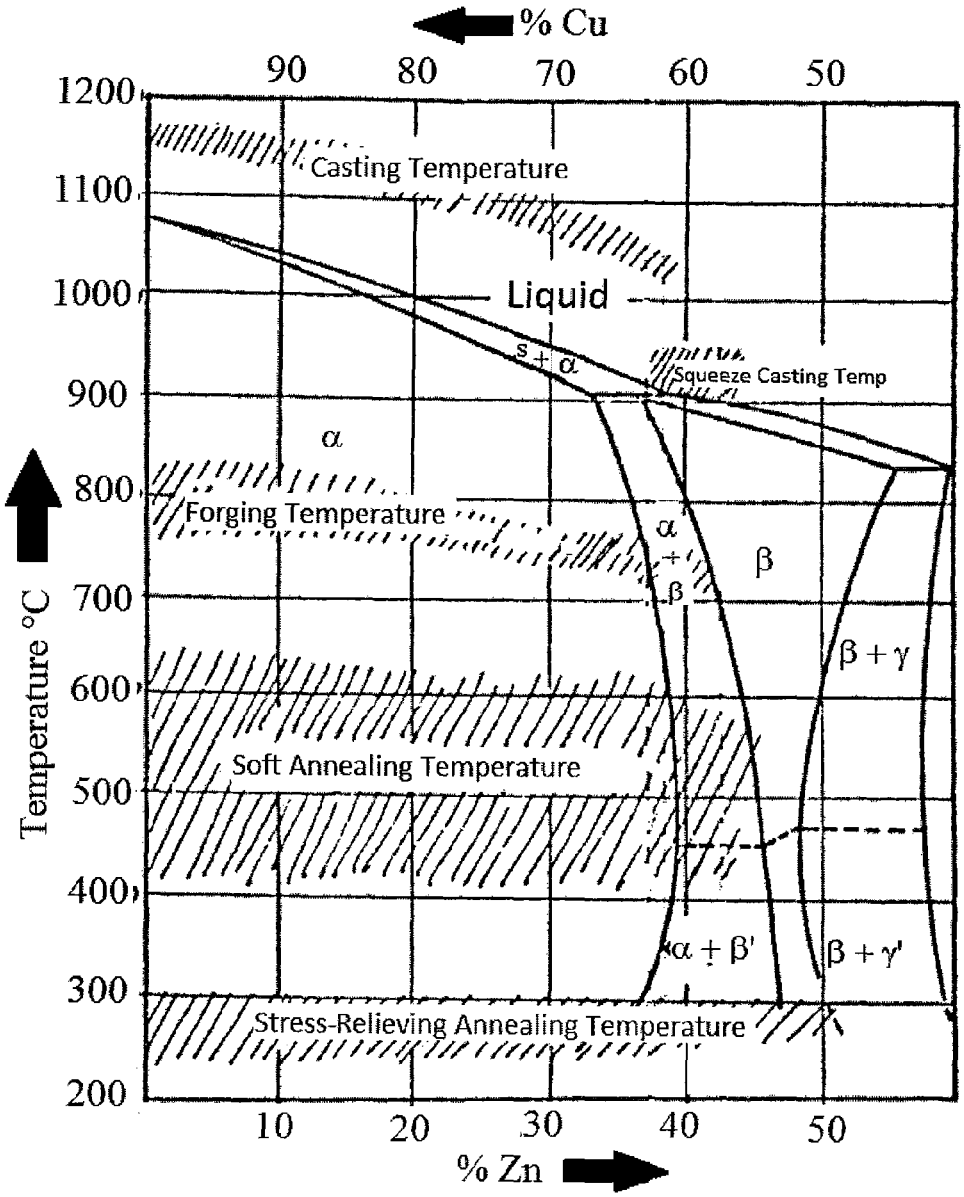
FIG. 1 illustrates an example of a phase map for a Cu—Zn system in prior art.
Figure 2:
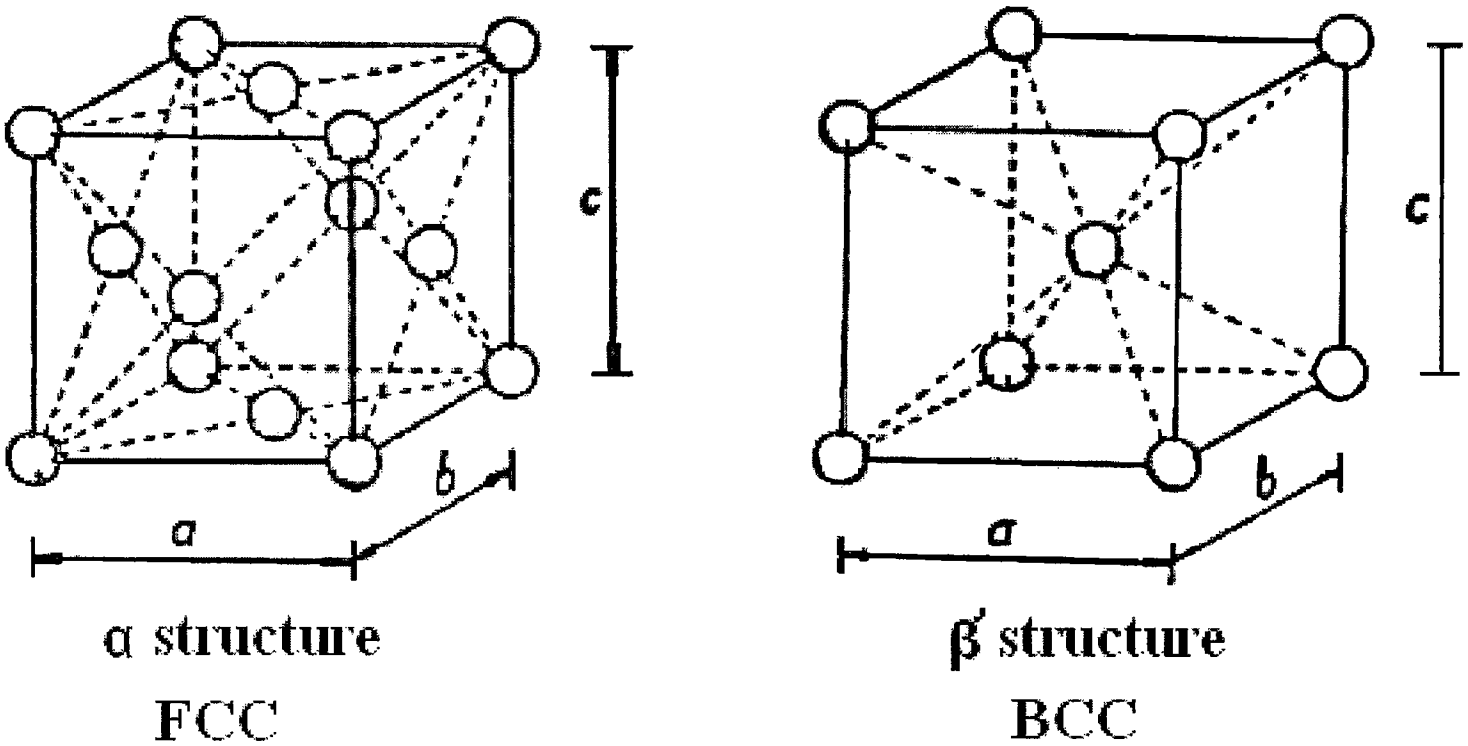
FIG. 2 illustrates an example of a respective α phase and β phase structure.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The main principle of the present invention is to provide an improved brass alloy providing at least the following material properties:

The material should be easy to be shaped.

The material should have good machining abilities.

The material should have very good resistance towards corrosion like dezincification.

The material should not be leaking any possible toxic component from any alloying element used in the manufacturing of the improved brass alloy according to the present invention.

In an aspect of the present invention, lead is replaced with silicon to provide machining ability. However, Silicon particles may provide severe wear and tear of tools used in the machining process. However, limiting the amount of silicon in the material together with heat treatment of the material may reduce the wear and tear of tools.

Dezincification may be stopped by adding arsenic and/or phosphorus as an alloying element.

As described above, these elements may provide leakage of toxic components to the environment. To avoid such leakage it is necessary to establish a limit for an amount for addition of alloying elements which makes it certain that almost all of the added alloying elements will be part of the final material structure, and therefore will be bounded by the material structure thereby inhibiting leakage of these elements to the material structure.

These limits may vary due to different factors affecting the binding of for example arsenic in a given material structure. Further, other alloying elements may be added to provide other material properties than those directly described in this disclosure. Such added material may bind some of the arsenic for example. Therefore, it is within the scope of the present invention to establish a level or an interval of alloying elements that provides the material properties that are the object of the present invention.

In an example of embodiment of the present invention, a method for producing an improved alloy according to the present invention may comprise using a "clean" oven. This may be achieved by replacing used heat resistant stones in the oven with new stones. Then a charge is provided for in the oven.

In an example of embodiment of the present invention material that is used in the charge may be provided for from the following list of materials:

Cu elektro,

Zn 1020ZN/F SHG-Slag Boliden,

Cu/As 70/30 Outokumpu Nordic Brass,

Si.

In another example of embodiment of the present invention, the following list comprising re-circulated materials are used:

Non-isolated copper wire,

Copper rails,

Non-treated copper pipes,

Residues from cutting of copper plates or brass plates,

Unused copper from electrical transformers,

Bushings from artillery and hand weapons without spark caps.

It is within the scope of the present invention to use materials from both of these lists of materials when charge is performed of the oven.

The amount of each respective material used when charge is performed is according to the final wt % of each respective material in the final product, as known to a person skilled in the art.

It is also within the scope of the present invention to use a used oven. However, it is advantageous that the oven has been used with copper or brass. As known to a person skilled in the art a cleaning charge may be used first before a charge according to the present invention is performed. If necessary, additional cleaning charge operations may be performed. For example, if the oven has been used with more than 0.5 wt % lead and arsenic of more than 0.05 wt % arsenic, two successive cleaning operations are necessary.

The oven is preferably of an induction type of oven providing a stirring of the materials when they are melted in the oven. If the oven is not of an induction type of oven, a mechanical stirring mechanism may be used, or a gas system may be used as known to a person skilled in the art.

When a production is ongoing it is within the scope of the present invention to provide a sample analysis of the output material from the process. This can be done by performing a casting a small amount of material from the oven, then performing an analysis of the casted sample while the oven is kept hot. This sample analysis may be used to establish if the chemistry of the alloy is in order. Any correction may then be performed to correct any deviations by adding for example further alloying elements in the hot oven. This is known to a person skilled in the art. Further, the sample analysis may also comprise using an electron microscopic investigation to identify if any added alloying elements are free in the structure and thereby can leak to the environment.

There can be many reasons why this happens. For example, any heat treatment of the material may have been incomplete. Further, the wt% relationship between the alloying elements may be adjusted. The temperature has to be sufficient over a certain time interval. It is also important how cooling of the material takes place. For example, too quick cooling may "freeze" the high temperature state of the material and any wanted restructuring of the material may not take place. Any arsenic-containing phase in the material should be avoided. Such conditions can be revealed when using the electron microscopy investigation. Again it is possible to correct this situation by adding for example further alloying elements.

It is to be understood that this step of doing a sample analysis comprises a step of learning. For a given oven, a specific use of materials when performing charge may reveal optimal use of the different materials and provide secure process control. Therefore, this step of performing sample analysis may only be necessary in the start of producing a certain batch of material. This process can be viewed as an iterative process.

Figure 3:
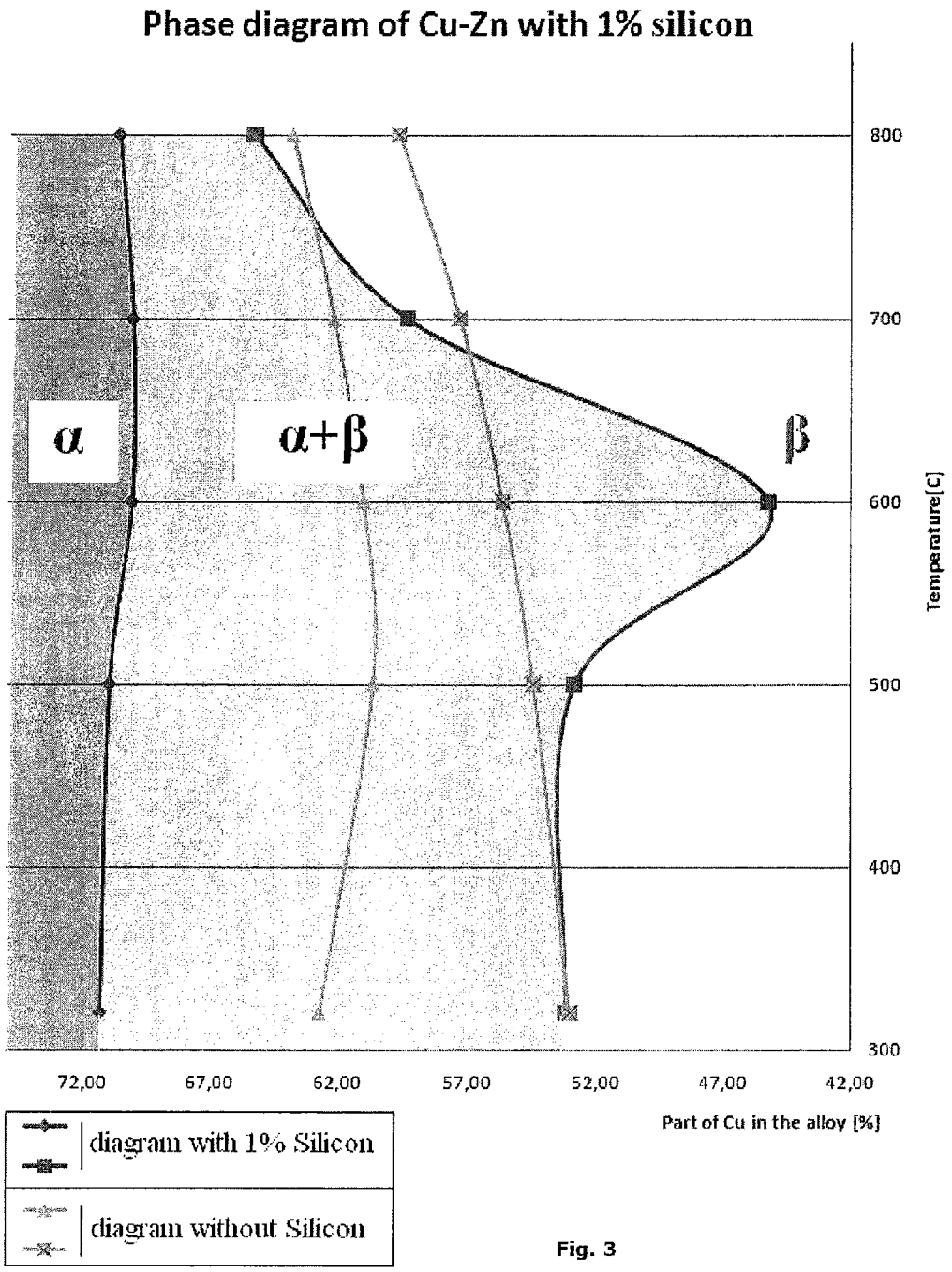
FIG. 3 illustrates an example of a phase map according to the present invention.

FIG. 3 illustrates a phase map for a Cu-ZN system with 1% Si according to the present invention. In this example it is depicted how to obtain a pure $\alpha$ phase material. In this example, a triggering of a transformation from a $\alpha+\beta$ phase to a pure $\alpha$ phase happens at a temperature of 600° C. The step of the sample analysis may be used to establish an optimal temperature for such a transition, for example by estimating an amount of residual $\beta$ phase material by investigating over a temperature range. The temperature providing minimum $\beta$ phase material is the temperature to be used. This can be viewed as an iterative process.

It is known in the literature, for example ASM Metals Handbook, $10^{th}$ ed. 1990, ISBN 0-87170-378-5, that a stabilization of the β phase in an α–β brass can be achieved with the addition of silicon. However, the result as disclosed in FIG. 3 indicates that an example of alloy according to the present invention achieve a remarkable stabilization of α phase in the temperature range of 400-680° C. which has not been disclosed or have been explained in the prior art.

The advantage is that the general stabilization of the β phase with silicon additions can be exploited in higher warm forming capability with the same Cu/Zn ratio in the alloy. The optimal CU/Zn-ratio is a balance between warm formability and degree of dezincification resistance since it is only α phase that can achieve dezincification resistance capabilities. In view of this fact α phase stabilization between 400-680° C. is of outmost importance. In order to obtain warm forming effects the temperature during forming has to be above 680° C. In order to obtain higher α/β-ratio, and hence higher dezincification resistance potential, a heat treatment can be performed in the temperature range of 400-680° C. Experimentally, the inventor has confirmed these features with an addition of 1 wt % silicon.

Further, by adding for example an arsenic inhibitor in the range disclosed above, and by performing an iterative learning cycle as described above, the environmental hazards identified with prior art brass alloys has been overcome at the same time as improved machining capabilities has been achieved.

According to an example of embodiment of the present invention, an improved lead free, free-cutting brass alloy comprising 60 to 69 wt % copper, 0.5 to 2.0 wt % silicon and the remaining wt % zinc and 0.005 to 0.015 wt % arsenic may be produced according to the above described example of method.

A lead-free, free-cutting copper alloy according to the present invention may be subject to a heat treatment for 30 minutes to 5 hours at 500 to 800° C.

A lead-free, free-cutting copper alloy according to the present invention may be subject to a heat treatment for 30 minutes to 5 hours at 400 to 680° C.

According to another example of embodiment of the present invention, a casting made from an improved brass alloy is cooled down to room temperature over a time interval spanning from 1 hour to two hours.

The improved brass alloy according to the present invention, fulfill the requirement of providing the following material properties:

The material should be easy to be shaped.

The material should have good machining abilities.

The material should have very good resistance towards corrosion like dezincification.

The material should not be leaking any possible toxic component from any alloying element used in the manufacturing of the improved brass alloy according to the present invention.

For example, alloy comprising 3 wt % silicon will typical wear out a tool if it is used in a turn bench for 3000 meter cutting. If the alloy comprises 1 wt % silicon the same test will provide a cutting of 30 000 meter.

In production facilities, the chip length is of interest when for example designing tools for the machining of brass alloys. The chip length should not be so long that it is a hindrance of the operation. 2 wt % silicon provides chip length of an average of 2 mm. 3 wt % silicon provides a chip length of average 2.5 mm. 1 wt % silicon provides a chip length of average 4 mm.

The invention claimed is:

1. A brass alloy characterized in that the brass alloy consisting of copper in a range of 60 to 69 wt %, silicon in a range of 0.5 to 2.0 wt %, an alloying element of arsenic in a range of 0.005 to 0.015 wt %, and the remaining wt % amount of the brass alloy is zinc.

2. The brass alloy according to claim 1, wherein the amount of silicon is 1.0 wt % silicon.

3. A brass alloy characterized in that the brass alloy consisting of copper in a range of 60 to 69 wt %, silicon in a range of 0.5 to 2.0 wt %, and an alloying element that is a combination of the arsenic in a range of 0.005 to 0.015 wt % and phosphor in a range of 0.005 to 0.02 wt %, where the remaining wt % amount of the brass alloy is zinc.

4. The brass alloy according to claim 3 wherein the amount of silicon is 1.0 wt %.

* * * * *